United States Patent [19]

Karytinos

[11] Patent Number: 4,918,899

[45] Date of Patent: Apr. 24, 1990

[54] BUILDING FRAME CONSTRUCTION

[76] Inventor: Alexandros Karytinos, 12 Churcher Street, Thorngate, Australia, 5082

[21] Appl. No.: 284,208

[22] Filed: Dec. 14, 1988

[30] Foreign Application Priority Data

Dec. 16, 1987 [AU] Australia ..... PI5935

[51] Int. Cl.[5] ..... E04B 2/58

[52] U.S. Cl. ..... 52/690; 52/241; 52/290; 52/348; 403/230

[58] Field of Search ..... 52/241, 242, 290, 243, 52/690, 481, 656, 238, 646, 348, 349, 350; 403/230, 231, 245; 182/228

[56] References Cited

U.S. PATENT DOCUMENTS

| | | | |
|---|---|---|---|
| 2,145,407 | 1/1939 | Soule | 52/481 |
| 2,267,477 | 12/1941 | Siebenlist | 52/290 |
| 2,931,468 | 4/1960 | Keller | 52/481 |
| 2,966,708 | 1/1961 | Freeman | 52/290 |
| 3,160,280 | 12/1964 | Burch | 52/241 |
| 3,680,271 | 8/1972 | Satchell | 52/656 |
| 4,038,799 | 8/1977 | Shanks | 52/241 |
| 4,809,476 | 3/1989 | Satchell | 52/241 |

*Primary Examiner*—John E. Murtagh
*Attorney, Agent, or Firm*—Clayton Johnson

[57] ABSTRACT

A frame system of upper and lower wall plates with interconnecting wall studs. The plates and studs are connected by grooves on the flanges of the studs mating with inturned ribs on the wall plates. The studs and wall plates being of roll-formed metal.

9 Claims, 4 Drawing Sheets

BUILDING FRAME CONSTRUCTION

This invention relates to an improved construction for a building frame, and is particularly directed to frame members wherein parallel members are interconnected by other members at right angles thereto, and for example, to a structure wherein there are upper and lower plates for a wall which are interconnected by wall studs. However, in building construction there are also other areas wherein the invention is applicable.

BACKGROUND OF THE INVENTION

The present construction of building frames utilizing metal frame members is to have channel plates, top and bottom, of a wall and these are interconnected by wall studs, the interconnections being with metal fasteners. It is important that the centers of the wall studs be accurately positioned because of the need to accommodate fixed sizes of the panels which are used and this is in turn a time consuming operation.

The main object of this invention therefore is to provide an improved construction which will reduce the amount of on site labour required, and will simplify the frame assembly.

BRIEF SUMMARY OF THE INVENTION

Briefly in this invention the upper and lower wall plates and wall studs for building frame construction are roll-formed from strip sheet metal to channel shapes, and at least the plates have inturned ribs and the ends of the studs are deformed to have grooves, the dimensions being such that a stud can be inserted into the channel portions of a plate and rotated so that the groove surfaces inter-engage with the inturned ribs, and the resilience of the members results in a very rigid frictional grip without the need for fasteners in most instances.

More specifically, a building frame substantially according to this invention comprises upper and lower wall plates and wall studs, each wall plate having a cross-section of general channel shape defined by two side flanges joined by a web, each flange having an inturned rib, the wall studs joining the upper and lower wall plates, each said wall stud also having a cross-section of general channel shape defined by two side flanges joined by a web, the flanges of each stud having surfaces defining grooves adjacent at least one end which interengage the inturned ribs of a plate upon erection and thereby firmly retain that stud end to that plate, said studs and wall plates being of metal.

The invention greatly reduces the on-site labour in the erection of a building frame, and the use of fasteners is almost, and sometimes completely, eliminated. Metal cladding is attached to the frame members.

BRIEF SUMMARY OF THE DRAWINGS

An embodiment of the invention is described hereunder in some detail with reference to and is illustrated in the accompanying drawings in which.

Figure 1:
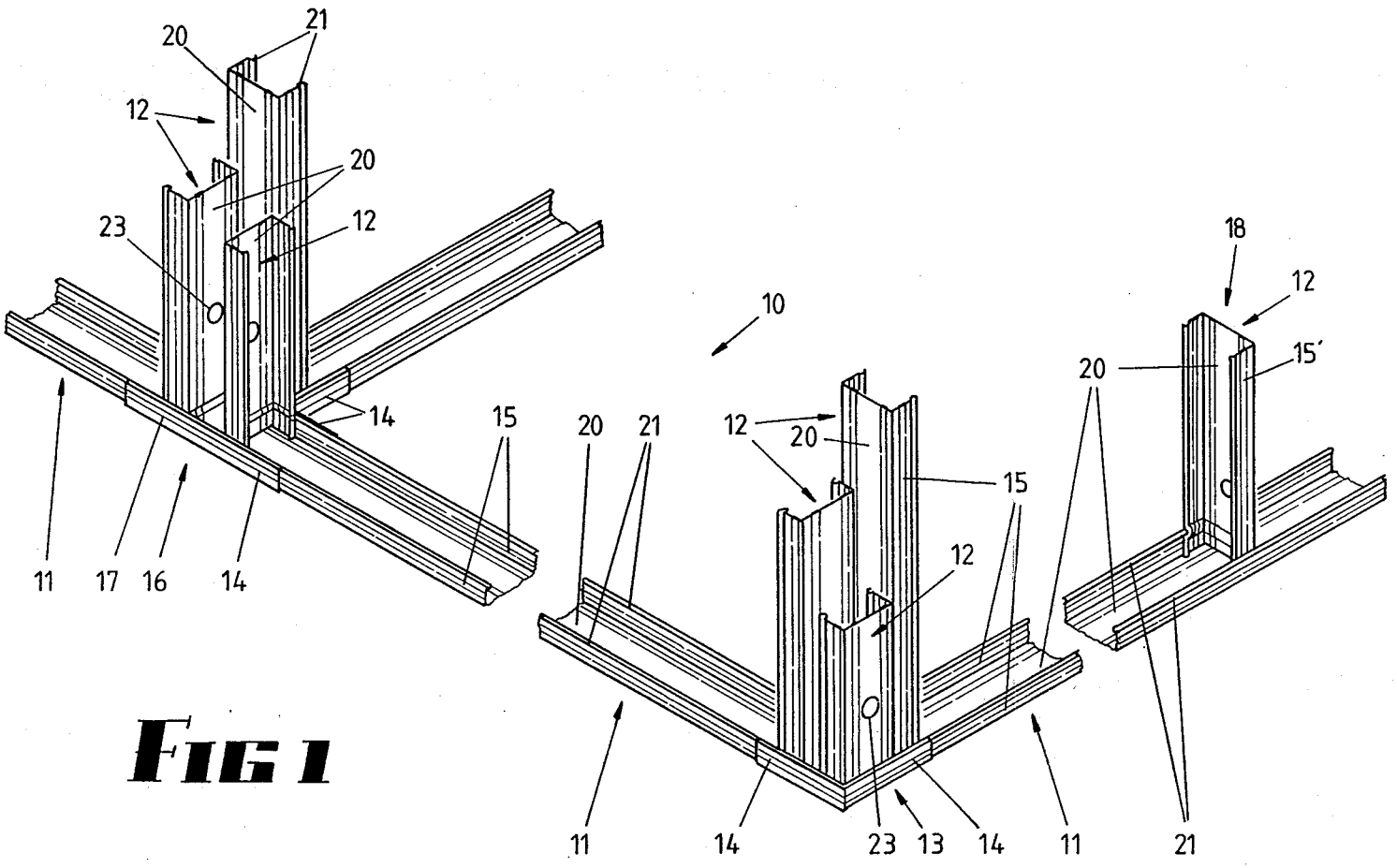
FIG. 1 is a fragmentary perspective view showing how the inter-engaging floor plates and studs may be inter-connected, FIG. 1 illustrating both L-shape configuration and T-shape configurations respectively for a building corner and an internal wall which abuts an external wall.

In this embodiment a building construction 10 comprises a plurality of floor plates 11, which are identical to upper wall plates (not shown) and are connected to the upper wall plates by a plurality of studs 12.

The building corner 13 defines an "L" configuration in plan, and adjacent plates 11 are retained in position by L-shaped corner channels 13 the flanges 14 of which engage the outer surfaces of the flanges 15 of the lower (floor) plates 11. Where an intermediate wall is to join an outer wall, it does so with a "T" configuration as shown at 16 wherein a T channel 17 operates in substantially the same way.

Since it is necessary to cover both the inner and outer surfaces of the frame with lining and cladding, flat surfaces must be presented to which this can be secured and this is achieved in this embodiment by having the wall studs arranged in groups of three where there is an "L" configuration or a "T" configuration. At these locations the studs are joined by means of fasteners but not elsewhere. The fasteners are not herein shown, but assist the groups or clusters of wall studs to provide considerably rigidity by increasing the least radius of gyration. Elsewhere, as shown at 18 in FIG. 1, the intermediate wall studs need no further stiffening. FIG. 1 shows only the lower or floor plates detail, upper wall plates being identical but inverted.

Figure 2:
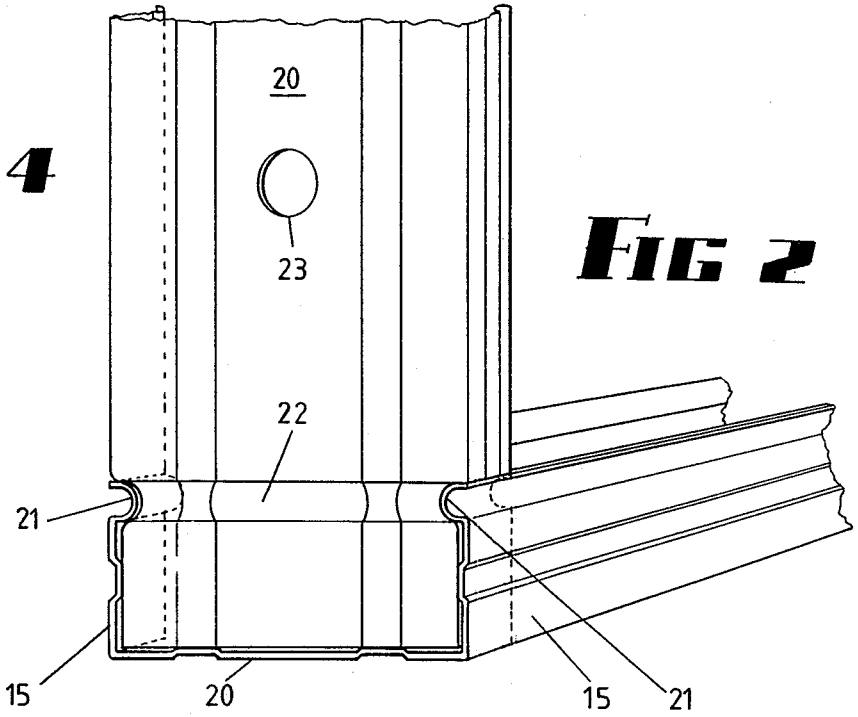
FIG. 2 is a fragmentary prespective view showing the engagement of the ribs of a floor plate with the grooves of a stud.

In this embodiment the upper and lower wall plates and wall studs are all roll-formed to the same cross-sectional size and shape from strip metal having a constant width and thickness. The roll-formed shape is best seen in FIG. 2 and has a generally channel shape, having two flanges 15 which are spaced from one another by a web 20, each flange 15 terminating in an inturned rib 21. The plates are of constant cross-sectional shape throughout their length but the wall plates are provided with inwardly deformed portions which provide groove surfaces 22 and these groove surfaces extend across the width of the flanges 15' and the webs 20. The studs also have apertures 23 for access to wiring, water conduits or the like.

The erection of a frame takes place by firstly locating the lower or floor plates 11 on suitable footings, then entering the lower ends of the studs 12 into the channel portions of the plates 11 and rotating them so as to effect the inter-engagement between the groove surfaces 22 and the ribs 21. Since the roll-forming has been to a constant shape, there is an interference fit such that the frictional engagement is very considerable and the studs can be easily located accurately and retain their positions without the need to use fasteners. It is frequently desirable however, for some fasteners to be used where the cluster of three studs is used for example at the localities 13 and 16.

The upper plates are then located over the upper ends of the studs and these are positioned by manually twisting the upper ends of the studs to allow them to enter the channel space of the upper plates and then forcibly rotate those upper ends to engage the upper plates. Finally, the L channels and T channels are positioned to overlie the studs at the corners 13 and at the T joins 16.

Finally, the building is completed by attaching the linings of the inner surfaces to the plates and studs and the cladding to the outer surfaces, using fasteners for that purpose and those fasteners retain the relative positions of studs and plates.

Figure 4:
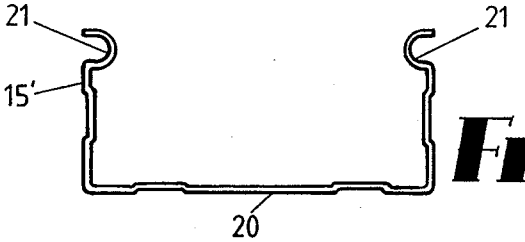
FIG. 4 is a plan of same.
Figure 3:
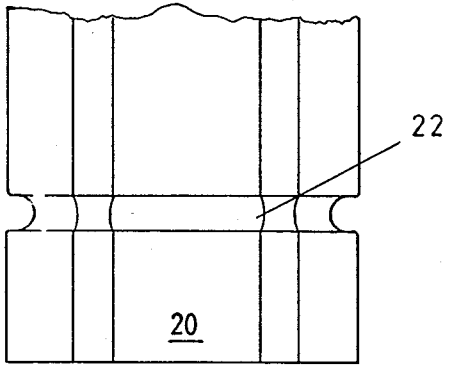
FIG. 3 is a fragmentary end elevation of the lower end of the stud.
Figure 5:
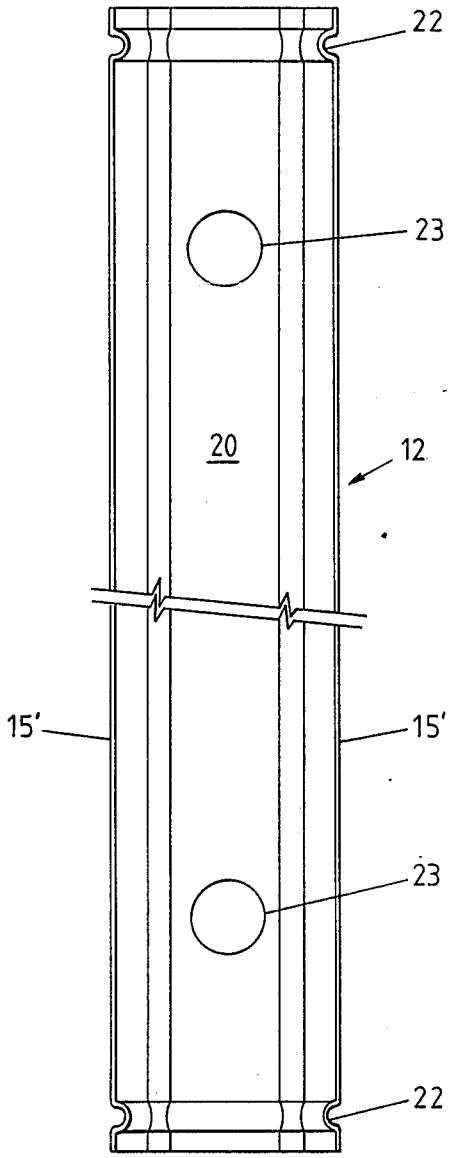
FIG. 5 is an elevational view of the channel face of a stud.
Figure 6:
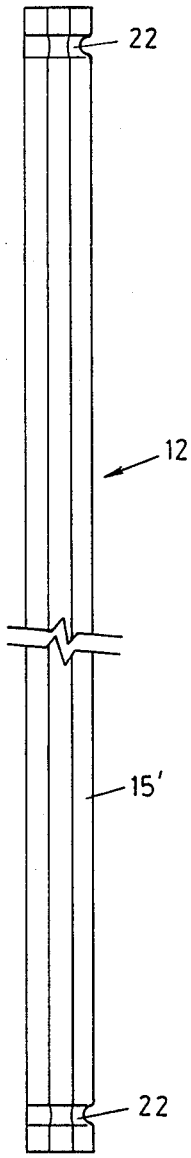
FIG. 6 is an end elevation of FIG. 5.

Many variations can be introduced within the invention and for example, at locations such as 13 and 16, special purpose sections can be used instead of the cluster of studs as illustrated in FIG. 1. As seen best in FIG. 4, the flanges 15 and 15', and the webs 20 have small deformations imparted to provide dimensional stability. These configurations can of course vary.

Figure 7:
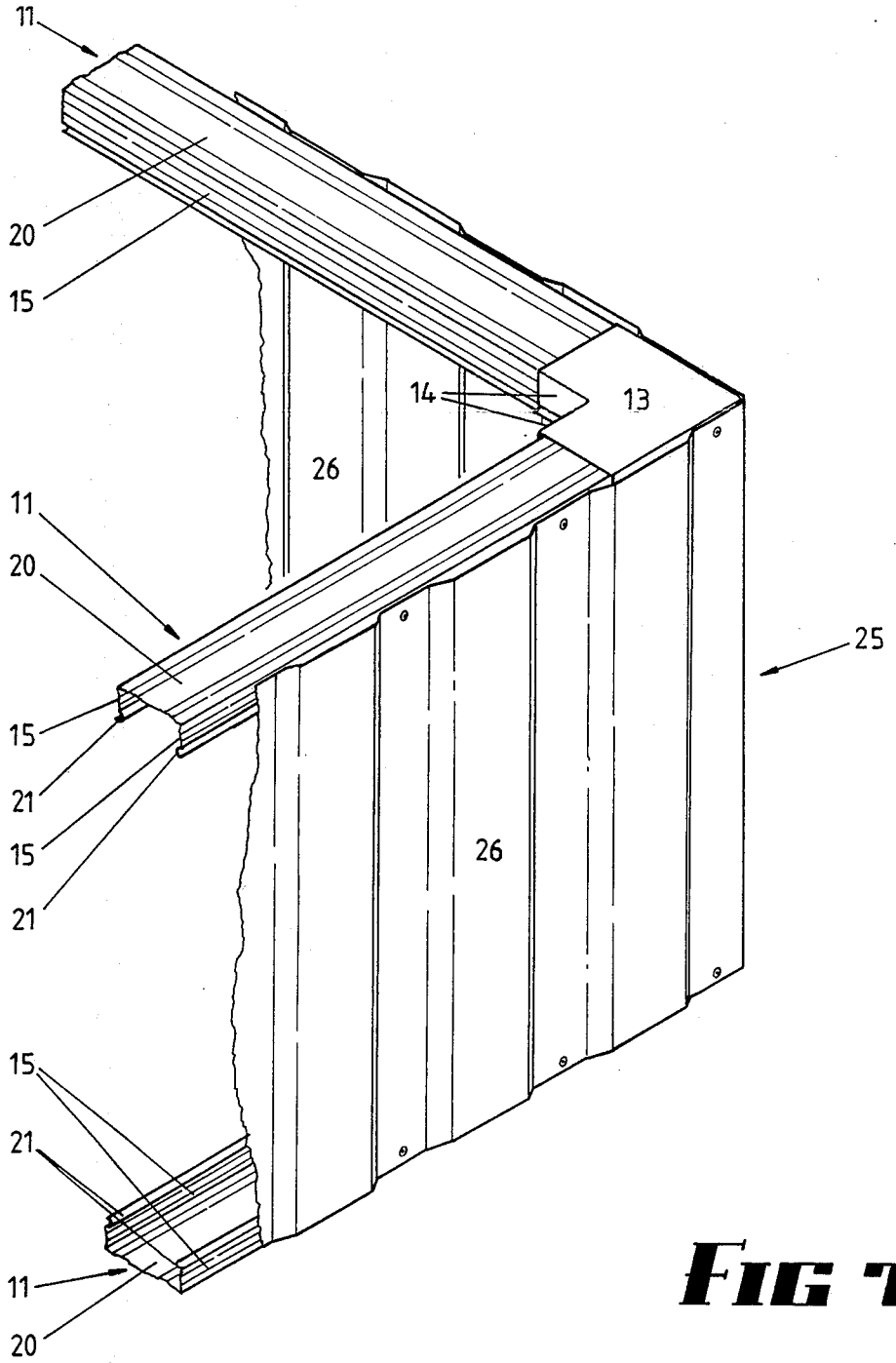
FIG. 7 is a perspective view illustrating the invention applied to a fence.

FIG. 7 shows an application of the invention to a fence 25, wherein a frame is constructed as in FIG. 1, and has cladding 26 fastened thereto by fasteners (or alternatively, has the cladding retained in the channels of the upper and lower plates 11, by the flanges 15).

The invention is also applicable to a brick veneer building, providing a frame to support a single brick wall on one side and an interior lining on the other side. This is not illustrated herein.

The claims defining the invention are as follows.

I claim:

1. Building frame construction comprising upper and lower wall plates and wall studs, each wall plate having a first end and being of a cross-section of a general channel shape that is defined by two side flanges and a web joined to and extending between the plate flanges, each plate flange having an inturned rib adjacent the plate first end, the wall studs joining the upper and lower wall plates, each of said wall studs also having a first end and being of a cross-section of general channel shape defined by two side flanges joined by a web, the flanges of each stud having imperforated deformations defining grooves extending across the full widths of the stud flanges adjacent at least that of said stud first end which inter-engage the inturned ribs of a plate to form an interference fit upon erection and thereby firmly retain that stud end to that plate, said studs and wall plates being of metal roll-formed to said channel shape.

2. Building frame construction according to claim 1 wherein the general cross-sectional size and shape of each said plate is the same as the general cross-sectional size and shape of each said wall stud.

3. Building frame construction according to claim 1 wherein the cross-sectional size and shape of each said plate is constant throughout its length, and is the same as the cross-sectional size and shape of each said stud for all of its length excepting at the location of the grooves.

4. Building frame construction according claim 1 wherein each stud web has a groove that extends thereacross and intersections the stud flange grooves.

5. Building frame construction according to claim 1 wherein said interengagement of the stud groove surface and the plate inturned ribs is effected by inserting a stud first end into the channel of the plate and rotating the stud.

6. Building frame construction according to claim 1 wherein the building frame has corners between walls in an "L" corners configuration, and wall joining other walls in a "T" configuration, further comprising joining channels having respective "L" and "T" shapes in plan, said channels overlying and underlying respective upper and lower wall plates, and three said wall studs joining the upper and lower plates at each said "L" and "T" configuration.

7. Building frame construction comprising upper and wall plates and wall studs, each wall plate having a first end and being of a cross-section of a general channel shape that is defined by two side flanges and a web joined to and extending between the plate flanges, each plate flange having a terminal edge portion that has an inturned rib adjacent to the plate one end and a free terminal edge more remote from the plate web than the respective plate rib, the plate terminal edges of each plate being more remotely spaced from one another than the minimum corresponding spacing of the plate ribs and the minimum spacing of the ribs being less than the maximum corresponding dimension of the stud web, the plate ribs extending generally parallel to the plate web, the wall studs joining the upper and lower wall plates, each of said wall studs also having a first end and being of a cross-section of general channel shape defined by two side flanges and a web joining the two stud side flanges, the flanges of each stud having deformations defining grooves extending across the full widths of the stud flanges adjacent to the respective stud first end in interengagement with the inturned ribs of a plate to form an interference fit to firmly retain that stud end to the respective plate, said studs and wall plates being of metal of a resiliency that with the grooves in interengagement with the inturned ribs form a rigid frictional grip.

8. Building frame construction according to claim 7 wherein each stud flange has a stud part having one edge joined to the respective stud web and a second edge joined to the stud flanges deformations, each stud flange has a free terminal edge more remotely spaced from the stud web than the respective stud grooves and the terminal edges of each stud being of a maximum spacing greater the minimum spacing of respective stud grooves and greater than the minimum spacing of the plate ribs.

9. Building frame construction according to claim 8 wherein the minimum spacing of the stud parts of each stud is greater than the minimum spacing of the stud grooves and that each inturned rib comprises a means defining a groove extending generally parallel to the respective plate web.

* * * * *